US009233386B2

(12) United States Patent
Mornan et al.

(10) Patent No.: US 9,233,386 B2
(45) Date of Patent: Jan. 12, 2016

(54) APPARATUS AND METHOD FOR PREVENTING CROSSWIND INTERFERENCE IN INDUCTION NOZZLES

(71) Applicants: Brian J. Mornan, Basking Ridge, NJ (US); Frank J. Beitz, Flemington, NJ (US)

(72) Inventors: Brian J. Mornan, Basking Ridge, NJ (US); Frank J. Beitz, Flemington, NJ (US)

(73) Assignee: Dyna-Tech Sales Corporation, Branchburg, NJ (US)

( * ) Notice: Subject to any disclaimer, the term of this patent is extended or adjusted under 35 U.S.C. 154(b) by 472 days.

(21) Appl. No.: 13/751,461

(22) Filed: Jan. 28, 2013

(65) Prior Publication Data

US 2013/0193235 A1 Aug. 1, 2013

Related U.S. Application Data

(60) Provisional application No. 61/593,480, filed on Feb. 1, 2012.

(51) Int. Cl.

| | |
|---|---|
| ***B05B 1/26*** | (2006.01) |
| ***F04F 5/46*** | (2006.01) |
| ***F23L 17/02*** | (2006.01) |
| ***B05B 15/00*** | (2006.01) |
| ***F23L 17/00*** | (2006.01) |
| ***F23L 17/08*** | (2006.01) |

(52) U.S. Cl.

CPC ..... *B05B 15/001* (2013.01); *F23L 17/005* (2013.01); *F23L 17/08* (2013.01)

(58) Field of Classification Search

CPC ..... B05B 15/001; F23L 17/005; F23L 17/08; F23L 17/02; F04D 29/663; F23J 2900/13003; F24F 2013/245; Y10S 454/906

USPC ..... 239/499, 419.5; 454/63; 181/224, 225

See application file for complete search history.

(56) References Cited

U.S. PATENT DOCUMENTS

| | | | | |
|---|---|---|---|---|
| 4,806,076 | A * | 2/1989 | Andrews | F23L 17/005 415/220 |
| 5,439,349 | A | 8/1995 | Kupferberg | |
| 6,112,850 | A * | 9/2000 | Secrest | F04D 29/663 181/224 |
| 6,431,974 | B1 | 8/2002 | Tetley et al. | |
| 2005/0170767 | A1* | 8/2005 | Enzenroth | B08B 15/002 454/36 |
| 2006/0179815 | A1* | 8/2006 | Means | F02K 1/825 60/39.5 |
| 2011/0053488 | A1* | 3/2011 | Gans | B08B 15/002 454/343 |

* cited by examiner

*Primary Examiner* — Steven B McAllister
*Assistant Examiner* — Reginald McNeill, II
(74) *Attorney, Agent, or Firm* — Thomas J. Germinario

(57) ABSTRACT

A modified version of an induction nozzle having a central "see-through" passive zone protects the induction ports from crosswind disruption. Modified features include: (i) a full-length wind band extending below the induction port inlets; (ii) multiple full-length mounting brackets, which impede circumferential crosswind flow around the nozzle; (iii) a transverse induction port separation plate, orthogonal to the centerlines of the induction ports; and (iv) elimination of one induction port opening.

2 Claims, 9 Drawing Sheets

APPARATUS AND METHOD FOR PREVENTING CROSSWIND INTERFERENCE IN INDUCTION NOZZLES

REFERENCE TO RELATED APPLICATION

The present application claims the benefit of the filing date of Provisional Patent Application No. 61/593,480, filed Feb. 1, 2012.

BACKGROUND OF THE INVENTION

The present invention relates to the field of exhaust air systems for buildings and/or other enclosed areas, and more particularly, to exhaust discharge nozzles configured to be attached to the outlets of exhaust fans, exhaust ducts and/or stacks, and similar exhaust type equipment/devices and are specifically designed to be installed in the outdoor ambient. The device is designed with a constriction at the outlet to accelerate the exhaust effluent at a high velocity into the atmosphere.

The present invention is related to the disclosure of U.S. patent application Ser. No. 13/067,269, which is incorporated herein by reference.

The application of discharge nozzles at the exit point of exhaust systems enhances the performance capability with the specific intent of maximizing the exhaust/effluent dispersion into the upper atmosphere of the unwanted contaminated air and/or effluent gases and vapors from buildings, rooms, and other enclosed spaces. They are able to provide a superior alternative to conventional tall exhaust stacks which are costly to construct and are visually unattractive by today's standards. Properly designed nozzles are capable of propelling high velocity plumes of exhaust gases to heights sufficient to prevent stack downwash and disperse the effluent over a large upper atmospheric area so as to avoid exhaust contaminant re-entrainment into building ventilation intake zones.

A further development of the constrictive exhaust nozzle design is the type of nozzle that employs the Venturi effect to draw additional ambient air into the primary effluent stream. The venturi type nozzle can further be described as an aspirating, or induction type, as related to conventional technological description for this type nozzle. The additional induced air volume dilutes the primary exhaust gases at/near the nozzle as the combined mixed air volumes are released into the atmosphere. Also, with this exhaust-air mixture volume increase, the discharged gas is expelled at a higher velocity, achieving a greater plume height. The underlying effect of greater volume at greater discharge velocity is increased effluent momentum, which assists with the effluent disbursement into the atmosphere.

One of the limitations of the prior art in this field relates to the performance of the nozzle in a crosswind. Crosswinds not only affect the external plume height, in accordance with the Briggs equations, but they can also interfere with and limit ambient air entrainment into the nozzle, thereby impairing the performance at the nozzle discharge. The current industry test standard, AMCA 260-07, is a static test based on a zero crosswind velocity, which does not reflect the true application of these devices. Therefore, the industry has not yet addressed the effect of crosswind "blow through" that can take place. The present invention addresses this prevalent problem to which the prior art is susceptible. FIG. 1 illustrates the significantly degraded performance of one of the prior art induction nozzles in a crosswind (15 mph), as compared with the present invention, which enables substantially unimpaired performance in the equivalent crosswind.

Among the features of some of the prior art nozzles that render them particularly susceptible to crosswind "blow through" is the interconnection of their induction ports. Several prior art designs use a bifurcated frusto-conical nozzle with a "see-through" central passive zone that functions as the inlet for induced air flow. In the static condition (no crosswind), as illustrated in FIG. 2, ambient air enters the interconnected induction ports and is discharged through the nozzle outlet along with primary air. But in the dynamic condition (with crosswind), as shown in FIG. 3, this "see-through" design allows crosswinds to freely "blow through" the nozzle's passive zone instead of entering the aspiration air column and mixing with the primary exhaust discharge. Such crosswind pass-through impairs the performance of the nozzle by diminishing induction flow and reducing the nozzle discharge volume, thereby also reducing plume height.

Examples of nozzles with "see-through" interconnected induction ports, of the type illustrated in FIG. 4A-C, are disclosed in the U.S. patents of Andrews (U.S. Pat. No. 4,806,076), Kupferberg (U.S. Pat. No. 5,439,349), Secrest et al. (U.S. Pat. No. 6,112,850), and Tetley et al. (U.S. Pat. No. 6,431,974). The patent of Andrews teaches a bifurcated frusto-conical central nozzle which branches into dual arcuate primary exhaust air discharge outlets circumferentially disposed around a central "see-through" passive zone, which is the principal source of induced ambient air. The mixing of exhaust flows with induced ambient air takes place peripherally above the nozzle outlets. The wind band is not full-length over the nozzles and does not shield the passive zone ambient air inlets from crosswind disruption. Moreover, the interconnected "see-through" induced air inlets are subject to crosswind pass-through, which impairs nozzle performance, as explained above. The short wind band mounting brackets do not channel air into the induction zone inlets. The patents to Kupferberg and Secrest et al. are variations of the Andrews bifurcated "see-through" design.

The U.S. patent of Tetley et al. (U.S. Pat. No. 6,431,974) teaches the Andrews "see-through" design with multiple nested wind band sections in vertically spaced relation over the arcuate exhaust air outlets. This configuration sets up a succession of extra-nozzle peripheral mixing zones, as opposed to the single mixing zone of Andrews, Kupferberg and Secrest et al. Andrews' deficiencies with respect to full-length wind band and mounting bracket also apply to Tetley et al.

In the "Aspirating Induction Nozzle" described in U.S. patent application Ser. No. 13/067,269, a full-length wind band, extending from below the induction port inlets to above the nozzle discharge outlet, is used to protect the induction port inlets from crosswind disruption. The "Aspirating Induction Nozzle" design also uses full-length wind band mounting brackets, between the nozzle and the wind band, to form individual vertical air passageways for each of the ambient air induction ports, thereby preventing crosswinds from circumventing and disrupting the vertical flow of induced ambient air into the primary effluent flow. As depicted in FIG. 4C, the wind band design taught by the prior art is deficient in both of these aspects. The prior art wind band does not extend over the induction port inlets, thereby leaving them exposed to crosswind "blow through." Moreover, the prior art wind band mounting brackets are too short to form effective vertical air passageways for the induction ports.

SUMMARY OF THE INVENTION

The present invention is a modification of the prior art frusto-conical central nozzle with branching dual arcuate primary exhaust air discharge outlets circumferentially disposed around a central "see-through" passive zone, of the type disclosed in the Andrew patent (hereinafter referred to as a "see-through induction nozzle"). The modification of the Andrews nozzle design comprises four new features, which can be applied separately or in combination:

(1) a full-length frusto-conical wind band, attached in converging annular spaced relation to the exterior of the central nozzle by multiple mounting brackets, which wind band convergingly extends annularly around the central nozzle from at or below the induction port inlets to at or above the primary exhaust discharge outlets, as depicted in FIGS. 5A-E and 6;

(2) multiple full-length mounting brackets, extending the full length of the annular space between the exterior of the central nozzle and the interior of the wind band to define individual ambient air channels leading to each of the induction port inlets and/or terminal induction air and primary air converging points, as depicted in FIGS. 5A-E and 6. The mounting brackets function to maximize vertical crosswind flow attachment to the nozzle housing by creating explicitly defined segments where induction ports may or may not be located. This feature serves to influence crosswind streams to flow upward into the windband rather than to flow around the circumference of the nozzle;

(3) a transverse induction port separation plate, axially aligned with the centers of the two arcuate discharge outlets and orthogonal to the vertical plane passing through the center-lines of both induction ports inlets, so that the central passive zone is no longer "see-through" as shown in FIGS. 7A-C; and/or (4) a single induction port design, wherein there is only one induction port inlet opening, so that the dual arcuate primary exhaust air discharge outlets merge into a single arcuate discharge outlet circumferentially disposed around the central passive zone, which is no longer "see-through," as shown in FIGS. 8A-E and 9.

In this application, the full-length wind band functions in much the same way as it does in the "Aspirating Induction Nozzle" (U.S. patent application Ser. No. 13/067,269), that is, to shield the induction port inlets from crosswind effects that would otherwise divert and disrupt the upward flow of induced ambient air and thereby reduce both the volume and velocity of total air flow discharged through the nozzle, resulting in diminished plume height and degraded performance. The full-length wind band would optimally be combined with full-length mounting brackets, as depicted in FIG. 6, so as to block lateral crosswind currents inside the wind band and provide an isolated vertical ambient air channel for each induction port. This configuration can be applied for any multiple of induction port(s).

As shown in FIGS. 7A-C, the transverse induction port separation plate or baffle effectively bifurcates the central passive zone and segregates the two induction ports, so that a crosswind can no longer "blow through" the ports by entering one of the induction port inlets and exiting the other. By blocking the "path of least resistance" through the central passive zone, the lateral disruption of the upward flow of induced ambient air is eliminated. With this modification, crosswinds that enter either induction port on either side of the passive zone will be deflected and guided upward toward the nozzle discharge outlets, so as to combine with the primary exhaust air flow. The transverse induction port separation plate can be combined with the full length wind band and full length mounting brackets to minimize crosswind effects and optimize overall nozzle performance.

As an alternative to the transverse induction port separation plate, the single induction port design, as depicted in FIGS. 8A-E and 9 also eliminates crosswind "blow through" across the central passive zone by closing off one of the two port inlets and using only one induction port. This same principle can be applied to any multiple induction port configuration, by closing off one or more of the induction ports to eliminate "blow through" and thereby reduce crosswind influences.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENTS

Figure 1:
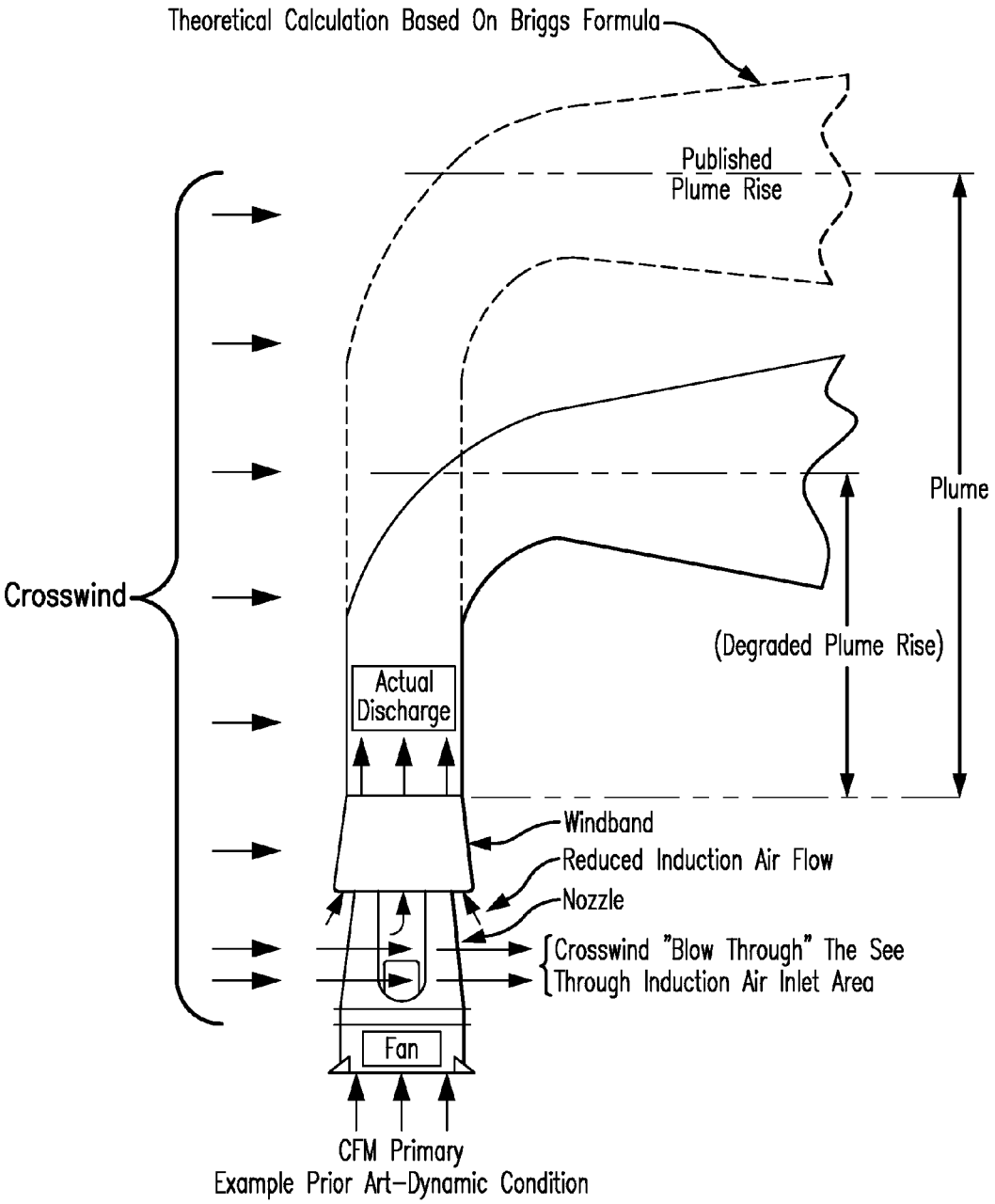
FIG. 1 is a schematic depiction of the modeled performance of a prior art "see through" induction nozzle in a 15 mph crosswind.
Figure 2:
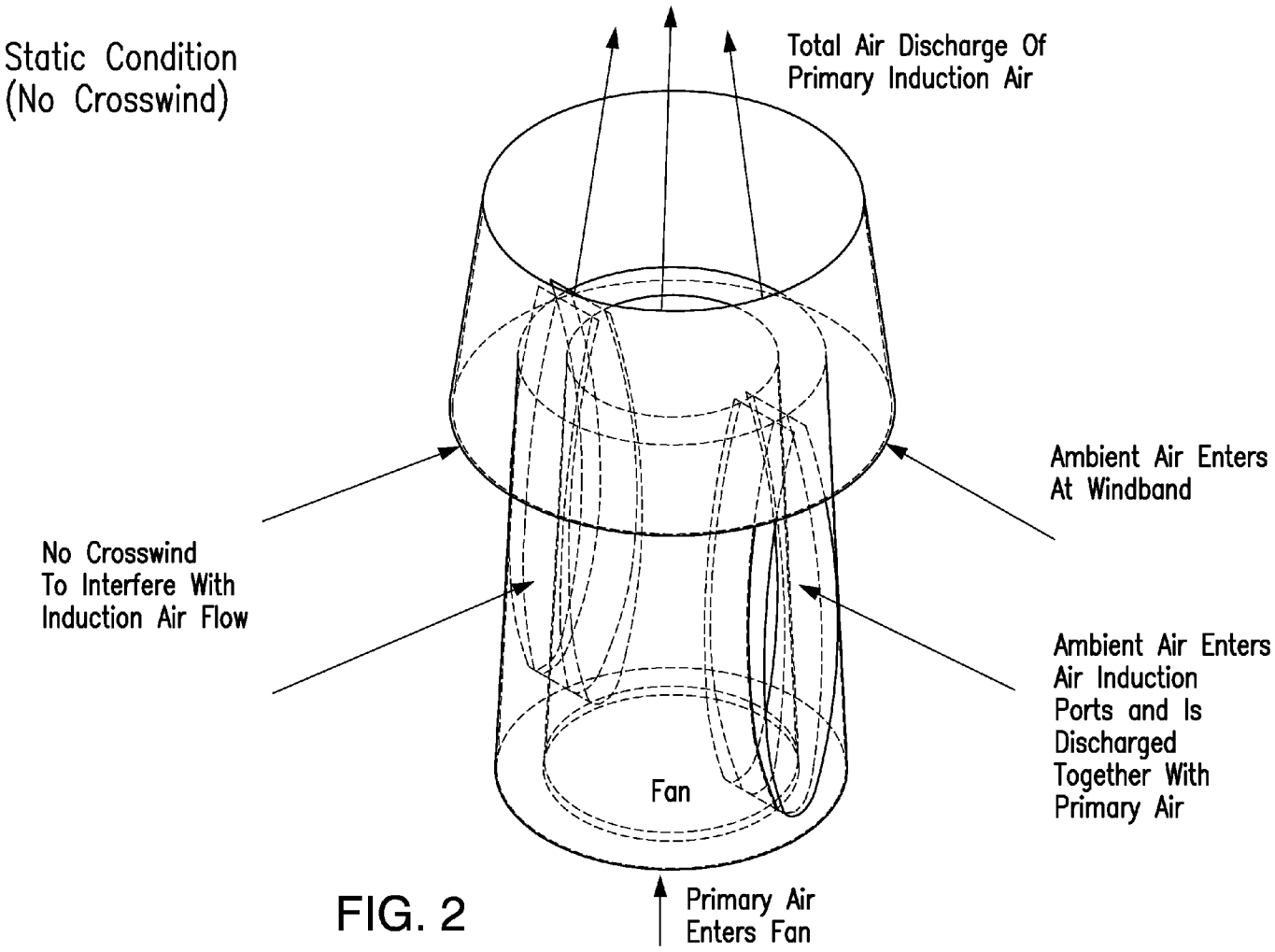
FIG. 2 is a perspective view of a prior art "see-through" induction nozzle operating in a static condition (with no crosswind)
Figure 3:
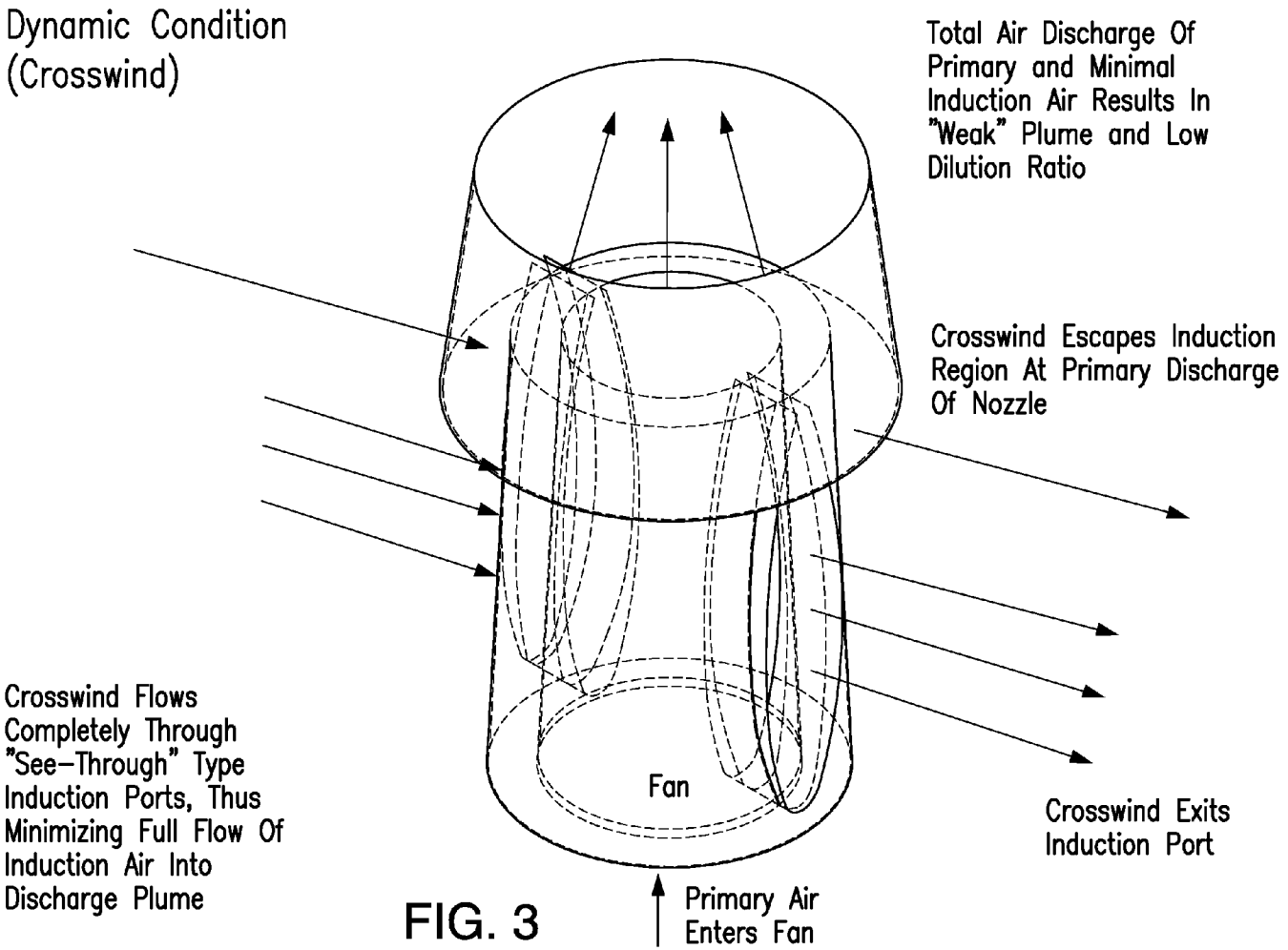
FIG. 3 is a perspective view of a prior art "see-through" induction nozzle operating in a dynamic condition (with a crosswind)
Figure 4C:
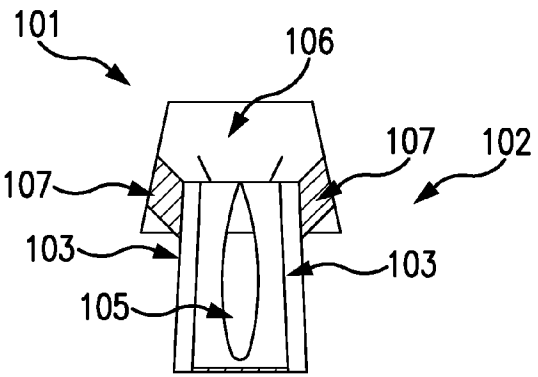
FIG. 4C is a cross-sectional view of the prior art "see-through" induction nozzle of FIG. 4A along Section D-D.
Figure 4A:
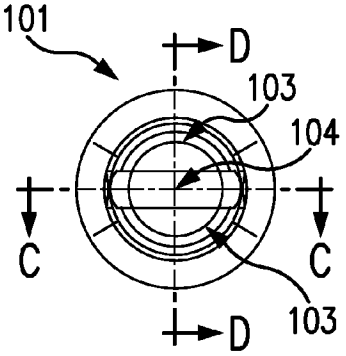
FIG. 4A is a top plan view of a prior art "see-through" induction nozzle.
Figure 4B:
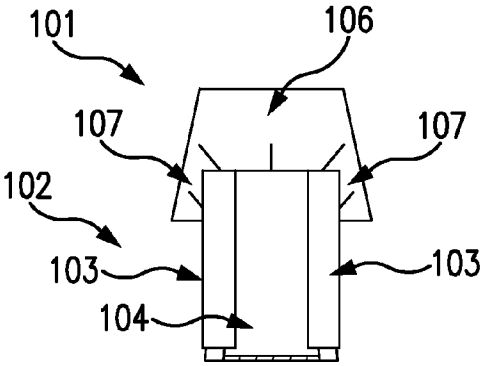
FIG. 4B is a cross-sectional view of the prior art "see-through" induction nozzle of FIG. 4A along section C-C.
Figure 5A:
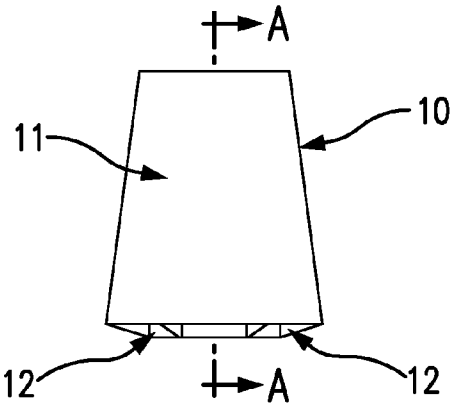
FIG. 5A is a front elevation view of an induction nozzle according to the first preferred embodiment of the present invention, with a full length windband and full length mounting brackets.
Figure 5B:
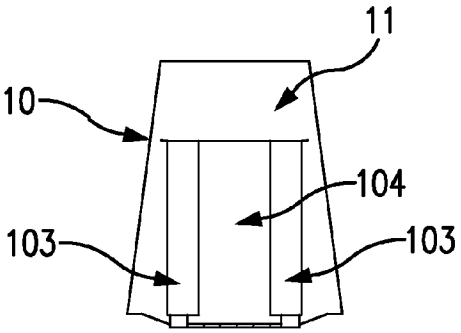
FIG. 5B is a cross-sectional view of the induction nozzle of FIG. 5A along Section A-A.
Figure 5D:
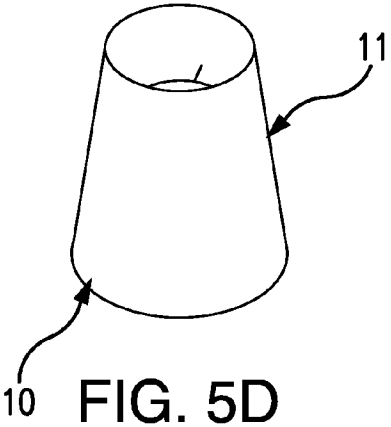
FIG. 5D is a top perspective view of the induction nozzle of FIG. 5A.
Figure 5C:
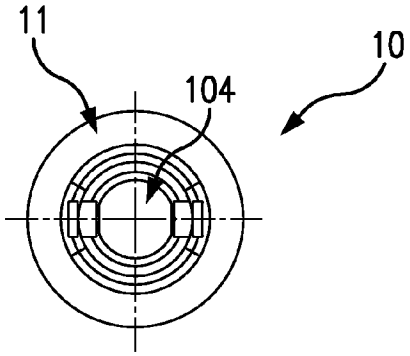
FIG. 5C is a bottom plan view of the induction nozzle of FIG. 5A.
Figure 5E:
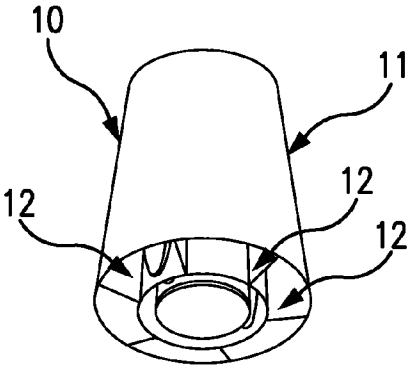
FIG. 5E is a bottom perspective view of the induction nozzle of FIG. 5A.

Referring to FIGS. 4A-C, the prior art "see-through" induction nozzle 101 comprises a frusto-conical central nozzle 102. The central nozzle 102 branches upward to form two arcuate primary exhaust air discharge outlets 103, which are circumferentially disposed around a central passive zone 104. The central passive zone 104 pneumatically communicates with the ambient air through two induction port inlets 105 on either side of the central nozzle 102. A frusto-conical windband 106 is supported in annular spaced relation to the exterior of the central nozzle 102 by multiple mounting brackets 107. The windband 106 extends above the central nozzle 102 from just below the primary exhaust discharge outlets 103, but does not extend downward to cover the induction port inlets 105.

Figure 6:
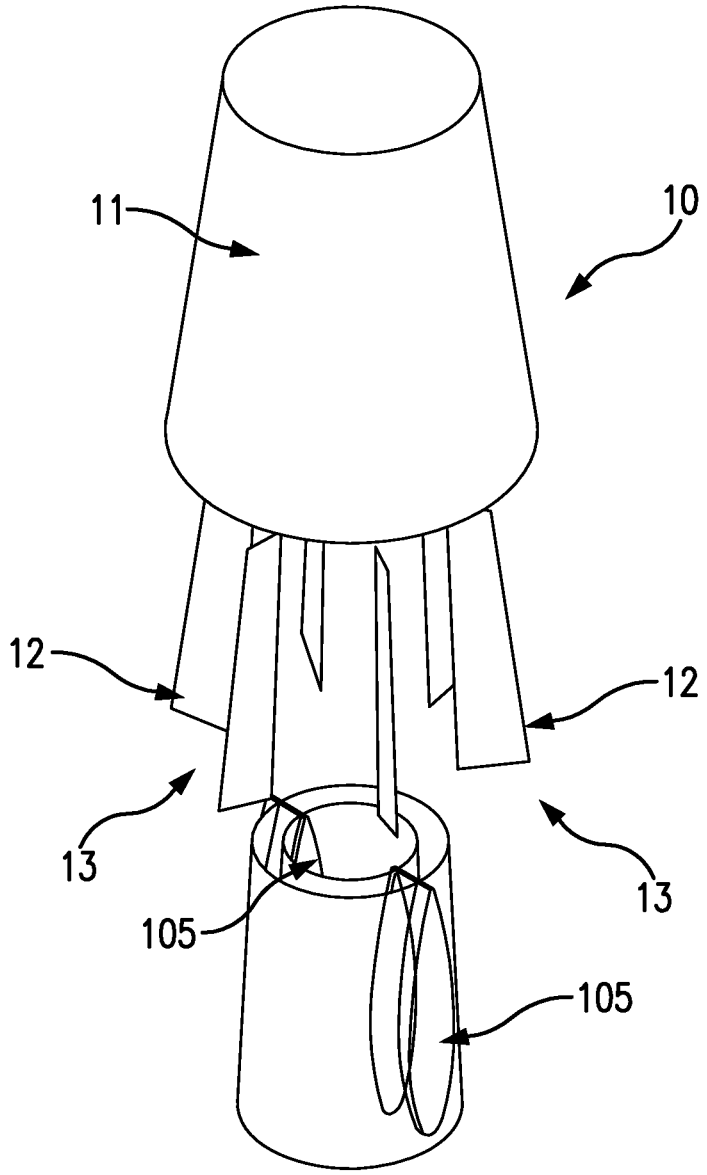
FIG. 6 is an exploded view of an induction nozzle according to the first preferred embodiment of the present invention, with a full length windband and full-length mounting brackets.

Referring to FIGS. 5A-E, the first preferred embodiment of the present invention 10 utilizes a full length wind band 11, which extends from at or below the induction port inlets 105 to above the central nozzle 102, thereby shielding the induction port inlets 105 from cross winds. Referring to FIG. 6, this embodiment also utilizes multiple full length mounting brackets 12, which extend the full length of the annular space between the exterior of the central nozzle 102 and the interior of the full length wind band 11, so as to define discrete ambient air channels 13, leading to each of the induction port inlets 105, and so as to block crosswind currents inside the wind band 11.

Figure 7C:
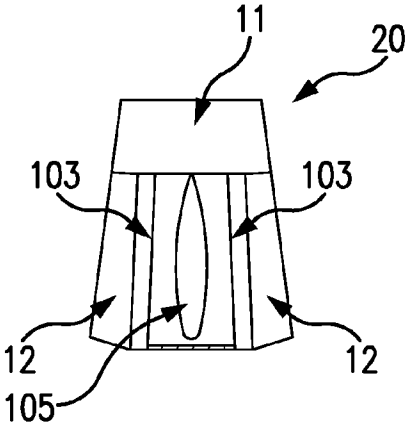
FIG. 7C is a cross-sectional view of the induction nozzle of FIG. 7A along Section B-B.
Figure 7A:
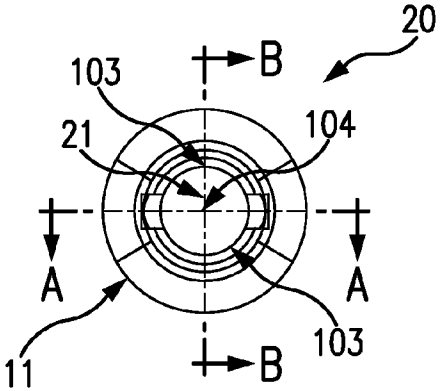
FIG. 7A is a top plan view of an induction nozzle according to the second preferred embodiment of the present invention, with a full length windband, full length mounting brackets, and a transverse induction port separation plate.
Figure 7B:
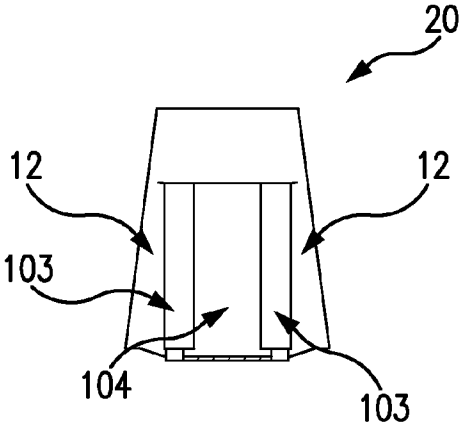
FIG. 7B is a cross-sectional view of the induction nozzle of FIG. 7A along Section A-A.
Figure 8D:
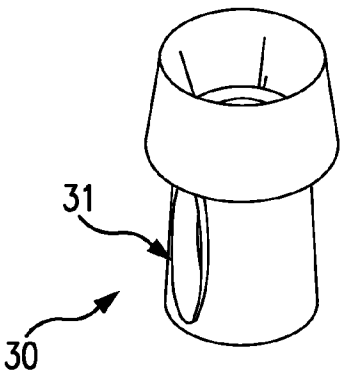
FIG. 8D is a top perspective view of the single-port induction nozzle of FIG. 8A.
Figure 8C:
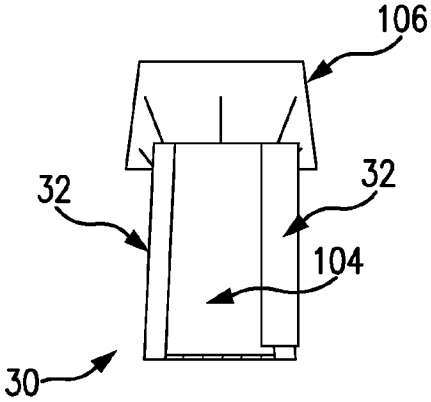
FIG. 8C is a cross-sectional view of the single-port induction nozzle of FIG. 8A along Section A-A.
Figure 8A:
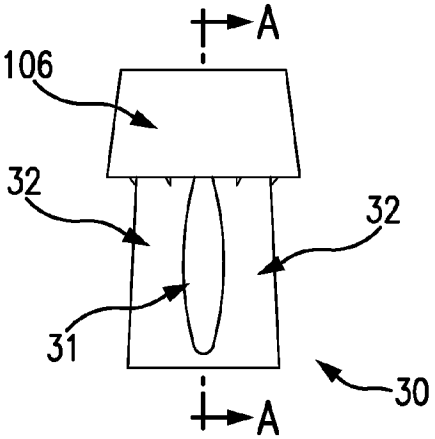
FIG. 8A is a side elevation view of a single-port induction nozzle according to the third preferred embodiment of the present invention.
Figure 8E:
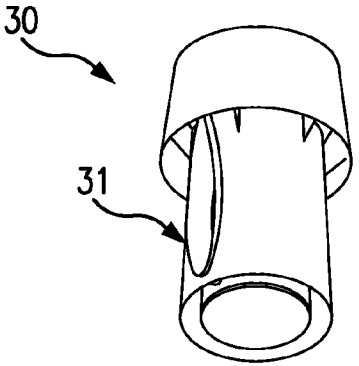
FIG. 8E is a bottom perspective view of the single-port induction nozzle of FIG. 8A.
Figure 8B:
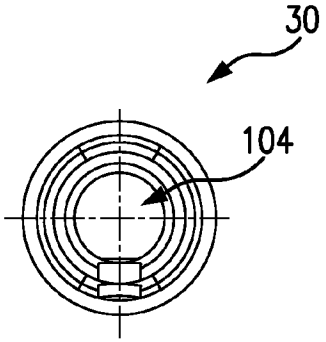
FIG. 8B is a bottom plan view of the single-port induction nozzle of FIG. 8A.

Referring to FIG. 7A-C, the second preferred embodiment of the present invention 20 introduces a transverse induction port separation plate 21, which bisects the central passive zone 104 along a plane orthogonal to the plane which joins the center-lines of the two induction port inlets 105. The induction port separation plate 21 effectively segregates the two induction ports inlets 105, so that cross winds can no longer "blow through" by entering one induction port and exiting the other. This embodiment also features the full-length wind band 11 and full length mounting brackets 12 of the first preferred embodiment, thereby implementing three levels of protection against crosswind interference.

Figure 9:
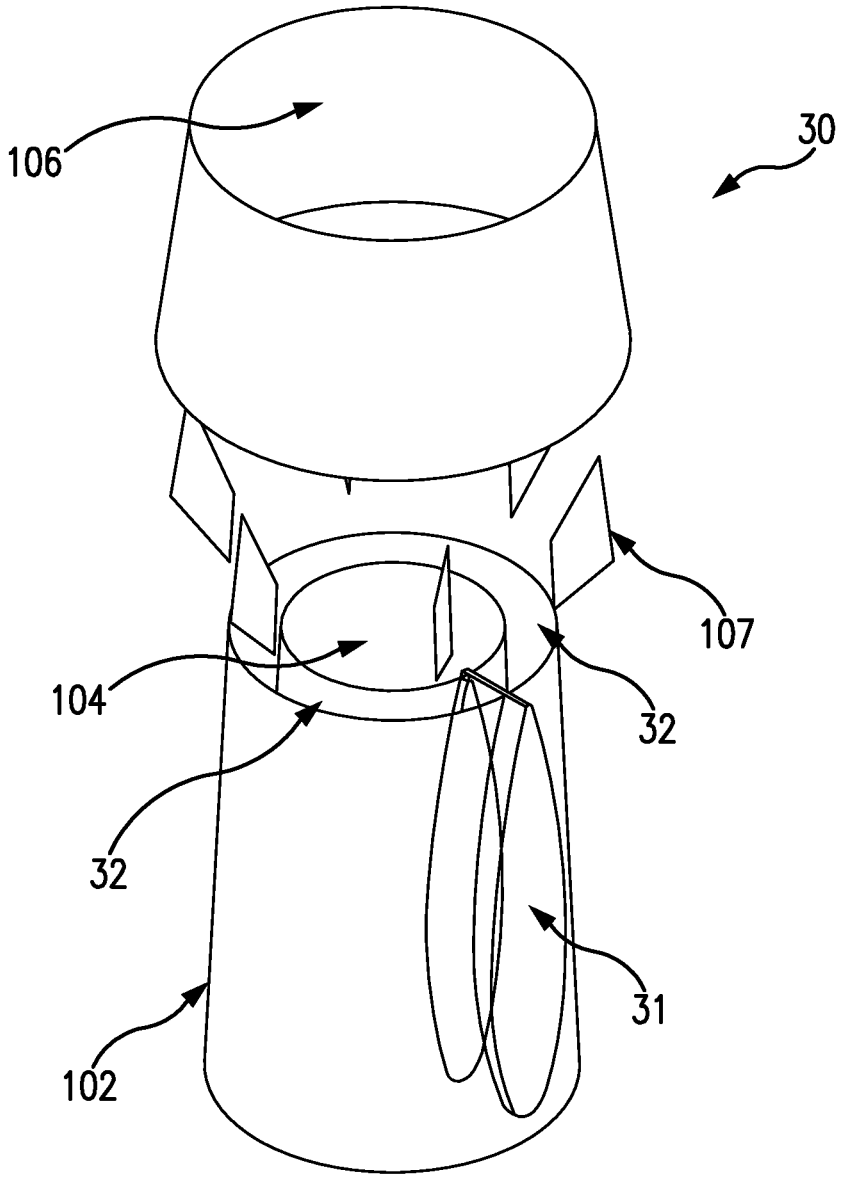
FIG. 9 is an exploded view of a single-port induction nozzle according to the third preferred embodiment of the present invention.

As an alternative to the transverse induction port separation plate 21, the third preferred embodiment 30 eliminates one of the two induction port inlets 105, and utilizes a single induction port inlet 31, as depicted in FIGS. 8A-8E and in FIG. 9. This design also prevents crosswind "blow through" across the central passive zone 104, because a crosswind that enters the single induction port inlet 31 can only exit upward through the top of the central nozzle 102 and through the wind band 106. In this design, the dual arcuate primary exhaust air discharge outlets of the prior art design 103 merge into a single arcuate discharge outlet 32, which is circumferentially disposed around the central passive zone 104.

Although the preferred embodiments of the present invention have been disclosed for illustrative purposed, those skilled in the art will appreciate that many additions, modifications and substitutions are possible, without departing from the scope and spirit of the present invention as defined by the accompanying claims.

What is claimed is:

1. An induction nozzle assembly for vertical connection to a pressurized exhaust gas outlet, comprising:

a frustum-shaped nozzle and a conforming frustum-shaped wind band, which is attached in converging spaced relation to the exterior of the nozzle by multiple mounting brackets;

wherein the nozzle comprises a nozzle inlet, which transitions into two nozzle branches, and wherein each of the nozzle branches terminates in a discharge outlet;

wherein the nozzle branches and the discharge outlets are circumferentially disposed around a central passive zone within the interior of the nozzle;

wherein the central passive zone pneumatically communicates with an ambient atmosphere outside the nozzle through two induction port inlets into the nozzle;

wherein the wind band extends from at or below the induction port inlets to above the discharge outlets of the nozzle, thereby shielding the induction port inlets and the central passive zone from crosswinds; and further comprising a transverse induction port separation plate, which bisects the central passive zone along a plane orthogonal to a plane through the center-lines of the two induction port inlets, such that the induction port separation plate effectively segregates the two induction port inlets so that a crosswind cannot blow through the central passive zone by entering one induction port and exiting the other.

2. The induction nozzle assembly of claim 1, wherein a separation space is formed between the exterior of the nozzle and the interior of the wind band, and wherein the mounting brackets extend through the entire length of the separation space so as to define multiple ambient air channels, which pneumatically communicate with the induction port inlets, and which block circumferential crosswind currents inside the wind band.

* * * * *